US007909685B2

(12) United States Patent
Heim, Sr. et al.

(10) Patent No.: US 7,909,685 B2
(45) Date of Patent: Mar. 22, 2011

(54) FLEXIBLE SERVICE CART

(75) Inventors: James R. Heim, Sr., Kalamazoo, MI (US); Thomas Kenny, Troy, MI (US); Robert Gilling, Caro, MI (US)

(73) Assignee: Spectrum Composites, Inc, Auburn Hills, MI (US)

( * ) Notice: Subject to any disclaimer, the term of this patent is extended or adjusted under 35 U.S.C. 154(b) by 1064 days.

(21) Appl. No.: 11/379,215

(22) Filed: Apr. 18, 2006

(65) Prior Publication Data

US 2007/0190921 A1 Aug. 16, 2007

Related U.S. Application Data

(60) Provisional application No. 60/772,277, filed on Feb. 10, 2006.

(51) Int. Cl.
*A47B 97/00* (2006.01)

(52) U.S. Cl. ..... 454/184

(58) Field of Classification Search ..... 454/184
See application file for complete search history.

(56) References Cited

U.S. PATENT DOCUMENTS 5,207,613 A * 5/1993 Ferchau et al. ..... 454/184
5,345,779 A * 9/1994 Feeney ..... 62/259.2
5,399,007 A * 3/1995 Marconet ..... 312/209
5,673,029 A * 9/1997 Behl et al. ..... 340/635
5,913,582 A 6/1999 Coonan
6,206,495 B1 3/2001 Peterson
6,493,220 B1 12/2002 Clark et al.
6,683,784 B1 1/2004 Bidwell et al.
6,722,673 B1 4/2004 Hamlin
2003/0114099 A1* 6/2003 Voorhies ..... 454/184
2003/0124971 A1* 7/2003 Williams ..... 454/184
2004/0129658 A1 7/2004 LeClerc
2004/0186357 A1* 9/2004 Soderberg et al. ..... 600/300

* cited by examiner

*Primary Examiner* — Steven B McAllister
*Assistant Examiner* — Samantha A Miller
(74) *Attorney, Agent, or Firm* — Currie Kendall PLC; Bruce M. Kanuch

(57) ABSTRACT

Service carts are provided that can be advantageously used to hold both diagnostic tools and repair tools and can be flexibly configured or customized for different work environments or worker preferences. The service carts include a cabinet having two side outer-walls, a back outer-wall, a bottom, and a top. The cabinet can include a plurality of configurable storage spaces with each storage space having a height that is approximately an integer multiple of a minimum storage space height. The cabinet can also be configured to provide electrical power into storage spaces in the cabinet. The cabinet top can comprise a plurality of slots adapted to hold mounting brackets adjustable along a length of the slots. The cabinet may include a fan that pulls air into the cabinet through a filter.

16 Claims, 6 Drawing Sheets

FLEXIBLE SERVICE CART

This application claims the benefit of the filing date of U.S. Provisional Application No. 60/772,277; filed Feb. 10, 2006; entitled "Flexible Service Cart;" the entirety of which provisional application is incorporated herein by reference.

FIELD OF THE INVENTION

The present invention relates generally to service carts useful in a variety of work environments, including facilities for servicing automobiles. More particularly, the present invention relates to service carts that are capable of being flexibly configured to carry and store both diagnostic tools and repair tools to meet the needs of a variety of work environments.

BACKGROUND OF THE INVENTION

Many work environments, including such work environments as facilities for servicing automobiles, hospitals, factories, and laboratories, have need for tool carts that can store easily-reachable tools needed for repair, such as tools needed to repair an automobile. Industry has provided tool carts in an effort to meet these needs. Many work environments also have need of diagnostic tools, such as a computer, that are easily reachable and industry has provided various computer workstations, computer stands or carts, and diagnostic workstations or carts in an effort to meet these needs. However, there exists a need for service carts that can hold both diagnostic tools and repair tools and that can be easily configurable or customizable for different work environments or worker preferences.

SUMMARY OF THE INVENTION

The present invention provides for service carts that can be advantageously used to hold both diagnostic tools and repair tools and can be flexibly configured or customized for different work environments or worker preferences. The service carts include a cabinet having two side outer-walls, a back outer-wall, a bottom, and a top. In a first preferred embodiment the cabinet includes a plurality of configurable storage spaces with each storage space having a height that is approximately an integer multiple of a minimum storage space height. In a second preferred embodiment, the cabinet includes an electrical outlet box inside the cabinet, the outlet box being electrically connected to an electrical power cord external to the cabinet; and at least one drawer having an electrical outlet positioned inside the drawer and electrically connected to the electrical outlet box. In a third preferred embodiment, the cabinet top comprises a plurality of slots adapted to hold mounting brackets adjustable along a length of the slots. In other preferred embodiment, the cabinet includes a fan that pulls air into the cabinet through a filter.

BRIEF DESCRIPTION OF THE DRAWINGS

The above and further advantages of this invention may be better understood by referring to the following description in conjunction with the accompanying drawings, in which like numerals indicate like structural elements and features in the various figures. The drawings are not meant to limit the scope of the invention. For clarity, not every element may be labeled in every figure. The drawings are not necessarily to scale, emphasis instead being placed upon illustrating the principles of the invention.

DETAILED DESCRIPTION OF THE INVENTION

Figure 1:
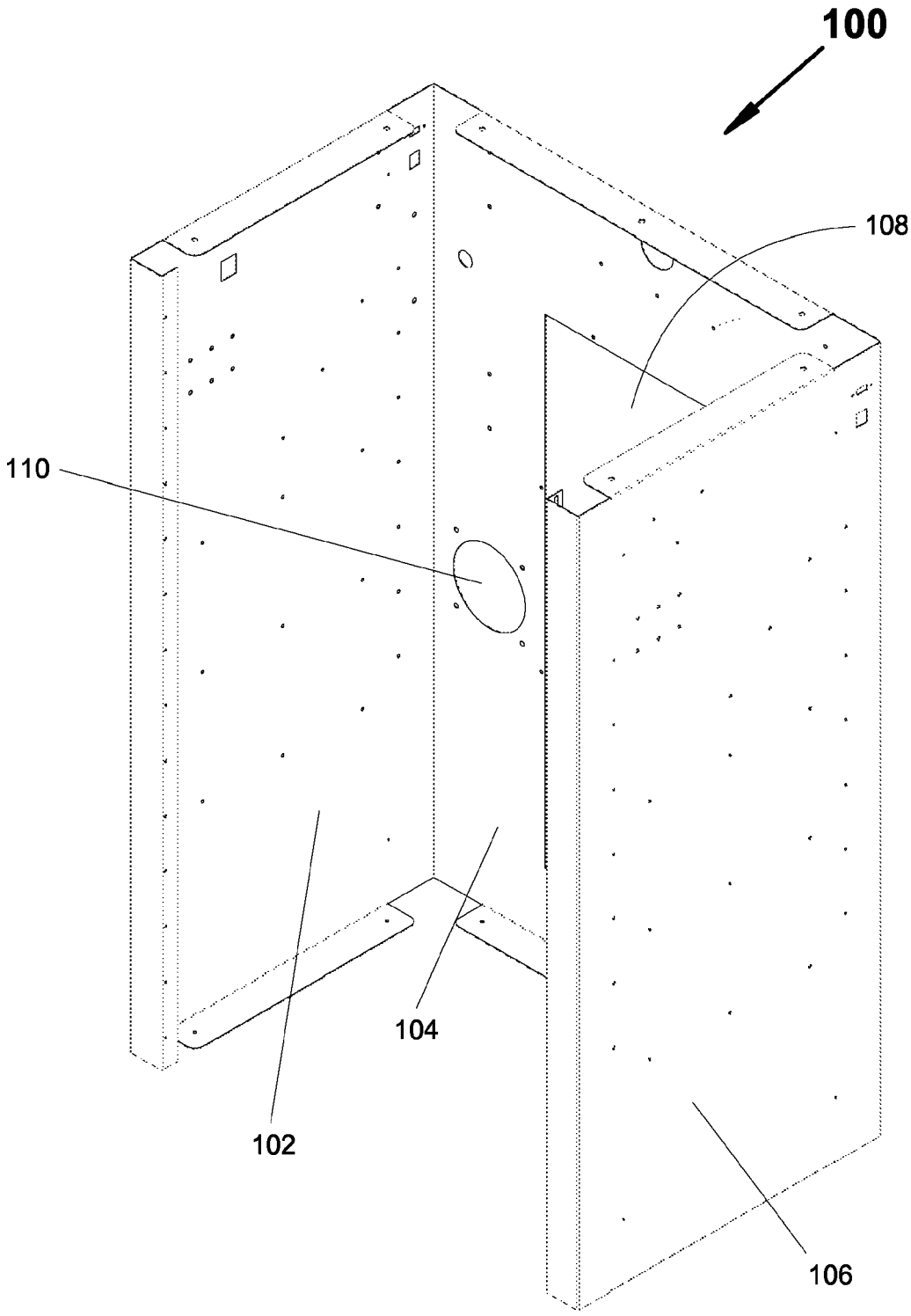
FIG. 1 shows a configuration in accordance with the present invention, including a back outer-wall, a left-side outer-wall, and a right-side outer-wall.

The present invention provides for service carts that can be advantageously used to hold both diagnostic tools and repair tools and can be flexibly configured, re-configured, and customized for different work environments or worker preferences. The service carts comprise a cabinet having a bottom, a top, two side outer-walls, and a back outer-wall. In preferred embodiments, the service carts of the present invention have a plurality of configurable storage spaces. Each storage space has a height that is approximately an integer multiple of a minimum storage space height. In one preferred embodiment, the minimum, storage space height is about 3 inches. Storage spaces include drawers and shelving space, for example. The storage spaces are configurable or customizable as they can have many different heights and be rearranged in substantially any order from top to bottom.

In preferred embodiments, service carts of the present invention have what is referred to herein as "in-the-drawer" power. An electrical outlet box is positioned inside the cabinet and is preferably attached to an inside surface of the back outer-wall. The outlet box is electrically connected to an electrical power cord that passes through the back outer-wall and can be plugged into an available electrical power outlet such as a standard wall outlet. With in-the-drawer power, at least one electrical outlet is positioned inside one or more drawers. Preferably, the electrical outlet is attached to a side, preferably a back wall, of the drawer. The outlet can be attached with any known means such as screws or bolts, for example. An electrical cord connects the electrical outlet in the drawer to the electrical outlet (described above) positioned inside the cabinet and preferably attached to an inside surface of the back outer-wall. As the drawer is opened and closed the electrical outlet and the connecting cord will move accordingly. Thus, the service cart is designed so that there is space between any drawers or shelves and the back-wall of the cabinet sufficient to allow movement of the connecting electrical cord. The in-the-drawer power allows any electronic device to be easily connected to an electrical power supply while the device is in the drawer. This is particularly advantageous for electronic devices that need to be recharged. Whenever the device is in the drawer, it can be easily plugged into the electrical outlet and left to recharge as long as it stays in the drawer. If desired, a lock can be put on the drawer so the recharging device can be secured while recharging. For example, an electronic device can be recharged overnight so that it is fully charged at the start of the next work day. When the device is needed, it can be removed from the drawer by unplugging it or removing from a charging station.

In preferred embodiments, At least one of the sides of the cabinet has an inner-wall attached to it. Preferably, both cabinet sides have an inner-wall attached to it. There is sufficient space between the inner-walls and the outer-walls to allow placement and movement of electrical cords. Electrical cords that may be placed between the inner-walls and the outer-walls may include, for example, power cords, including power cords for recharging electronic devices, and communications cables such as USB cables, phone cables, and data cables. The inner-walls have holes sufficient for passage of electrical cords from inside the cabinet, through the holes in the inner-walls, and back to the electrical outlet box (i.e., for power cords) or to a communications plate (i.e., for communication cords).

Preferable embodiments of the present invention will also have a communications plate positioned on the back outer-wall. The communications plate will advantageously comprise one or more communications jacks such as USB, RJ11, or RJ45, for example. Communications cables can be plugged into jacks on the outside of the communications plate and communications cables from electronic devices inside the cabinet can be positioned through the holes in the inner-wall(s) or through holes in the back of a drawer, for example, and plugged into jacks on the inside of the cabinet. In this manner, electronic devices can be placed in a drawer, or on a shelf in the cabinet, and plugged into power cables or communications cables. When the devices need to be removed from the cabinet, they can be easily unplugged from any cables and removed from the cabinet.

FIG. 1 shows a configuration 100 useful in embodiments of the present invention. The configuration 100 includes a back outer-wall 104, a left-side outer-wall 102, and a right-side outer-wall 106. In preferred embodiments of the present invention, the back outer-wall 104 includes a removable rear-access panel 108. Also, the back outer-wall 104 will preferably include a hole 110 for inserting a fan (not shown in FIG. 1). All three walls have numerous holes for inserting screws, bolts, rivets, etc. for attaching miscellaneous items as described herein.

Figures 2, 2A, 2B:
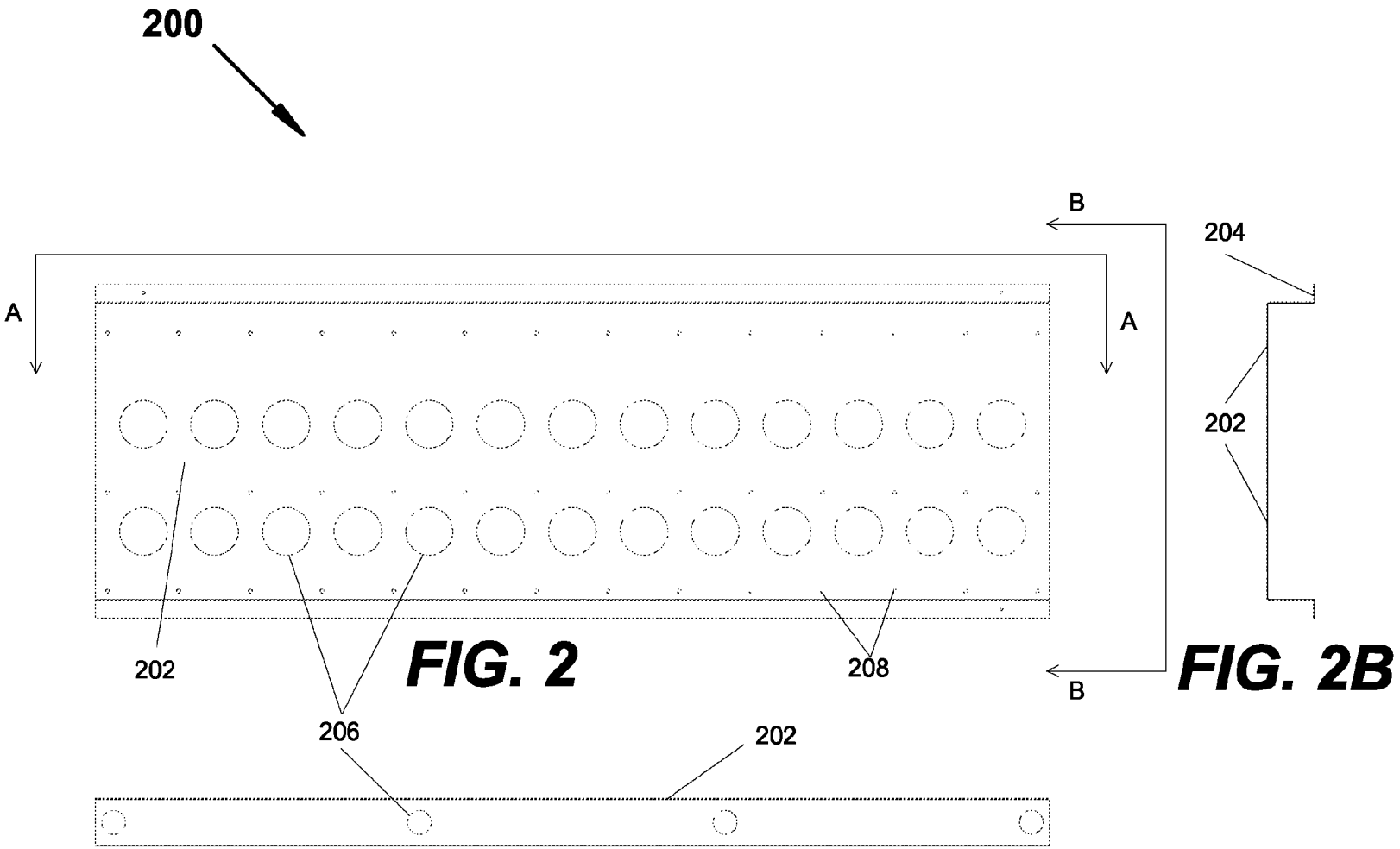
FIG. 2 shows a view of a side inner-wall in accordance with the present invention.
FIG. 2A shows a view of the side inner-wall shown in FIG. 2 taken in the direction indicated by the line A-A.
FIG. 2B shows a view of the side inner-wall shown in FIG. 2 taken in the direction indicated by the line B-B.
Figure 3:
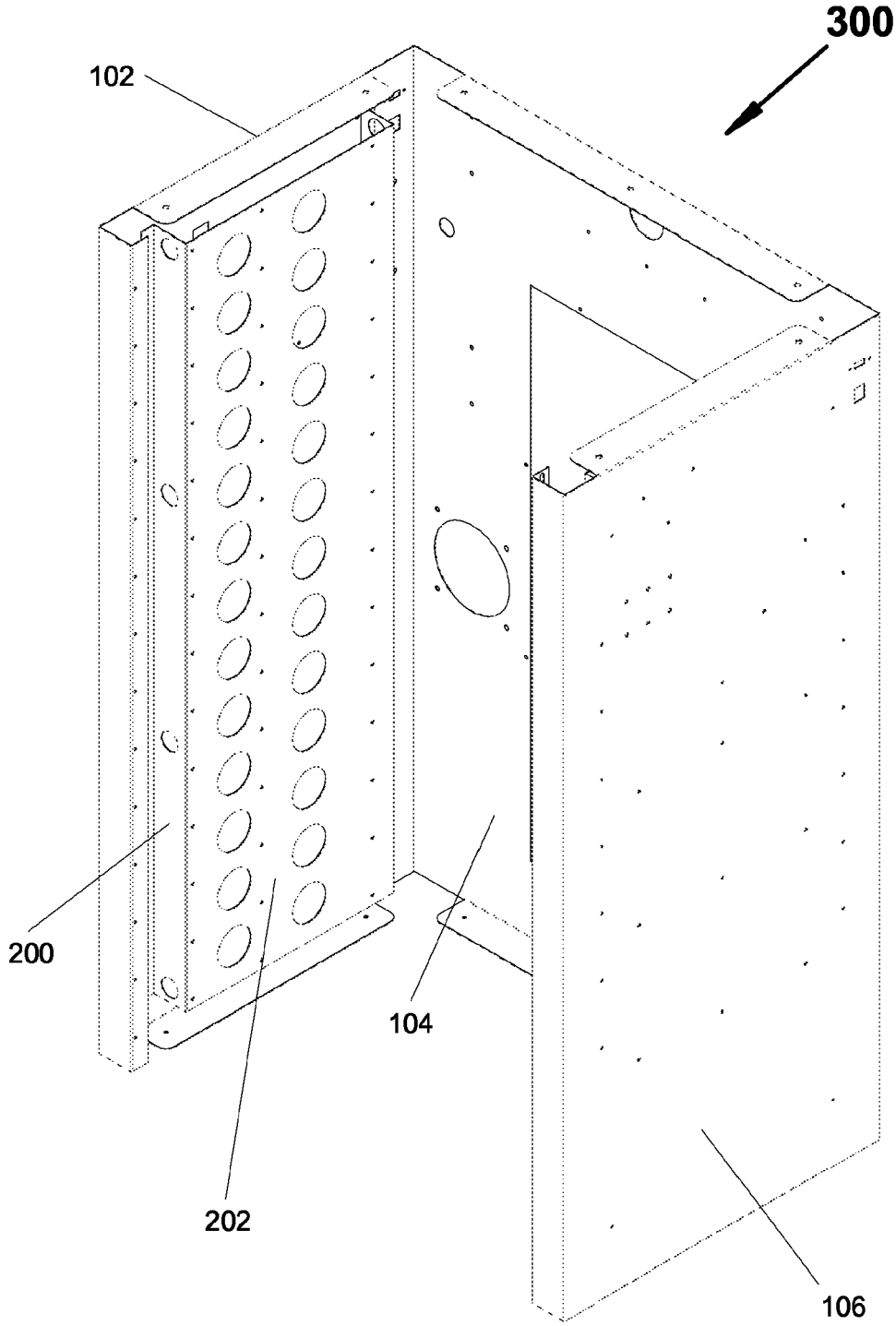
FIG. 3 shows a configuration in accordance with the present invention, wherein the side inner-wall of FIG. 2 is attached to the left-side outer-wall of FIG. 1.

FIGS. 2, 2A, and 2B show three different views of a side inner-wall 200. FIG. 2A is a view of the side inner-wall 200 taken in the direction A as indicated. FIG. 2B is a view of the side inner-wall 200 taken in the direction B as indicated. Preferably, side inner-walls are manufactured as "hat sections" as shown in FIG. 2B. The brim 204 of the hat section is typically used to attach the side inner-wall 200 to a side outer-wall as shown in FIG. 3. The inside surface 202 of the side inner-wall 202 faces the inside of the cabinet as shown in FIG. 3.

The side inner-wall 200 includes numerous larger holes 206 and smaller holes 208. The holes 206, 208 can be manufactured as imperforations or imprints, typically referred to as punch-outs, that can be removed to create a true hole in the side inner-wall 200. The larger holes 206 are sufficiently large to allow passage of electrical cords, such as the cords discussed above.

The distance between the smaller holes 208 defines the minimum, storage space height. In one preferred embodiment, these holes are positioned about 3 inches apart, making the minimum, storage space height about 3 inches. These holes 208 are adapted to allow shelves or drawer mounts, for example, to be attached to the side inner-wall 200. The height of storage spaces in service carts of the present invention are approximately an integer multiple of the minimum, storage space height. For example, if two shelves are positioned at consecutive holes 208, the distance between the two shelves (that is, the storage space height) would be approximately equal to the minimum, storage space height (for example, 3 inches). If the two shelves are positioned such that there is an unused hole 208 between the two shelves, then the distance between the two shelves would be twice the minimum, storage space height (for example, six inches).

FIG. 3 shows a configuration 300 useful in embodiments of the present invention, wherein the side inner-wall 200 has been attached to the left-side outer-wall 102. The side inner-walls can be attached to side outer-walls in any manner known in the art.

Figure 4:
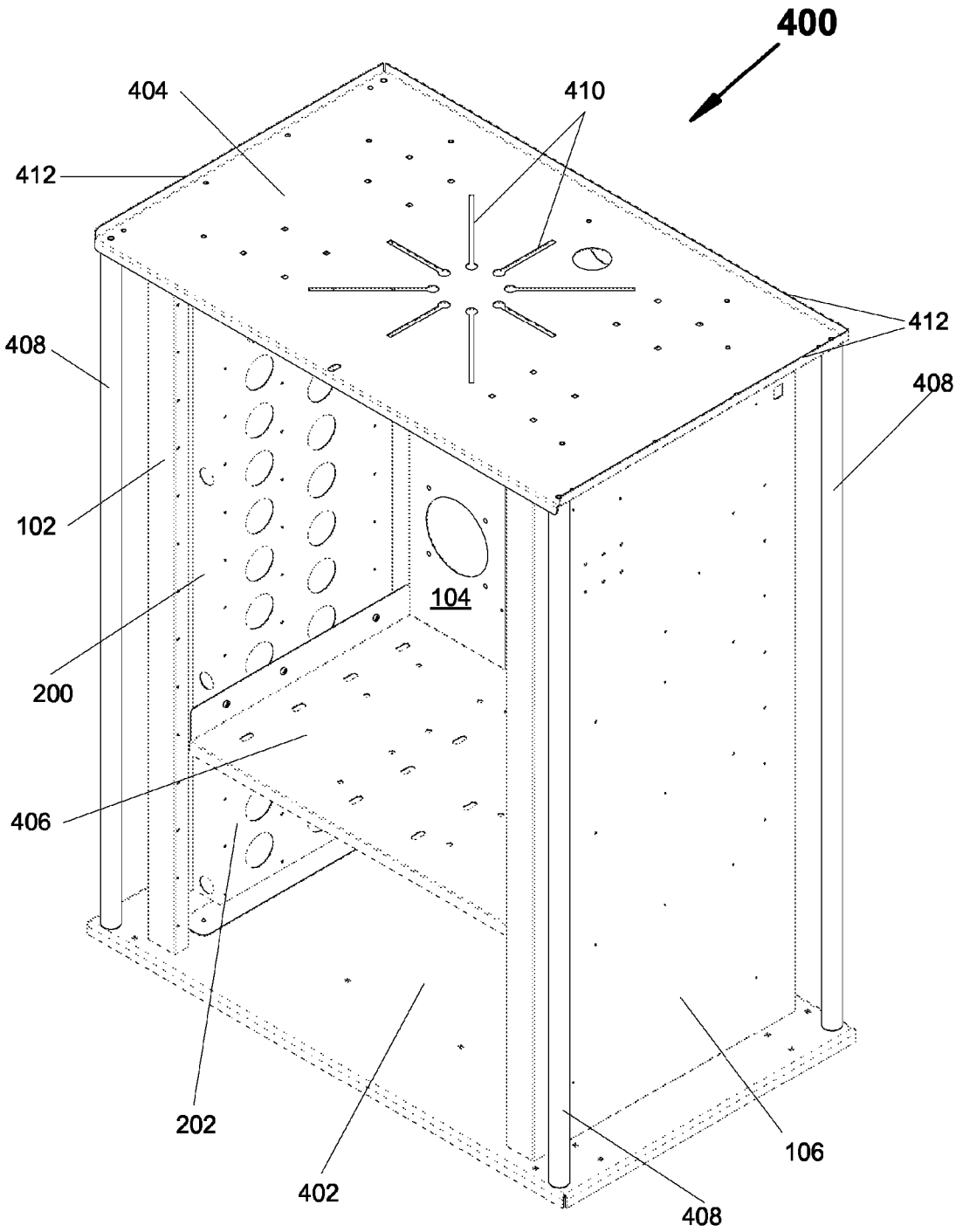
FIG. 4 shows a cabinet of the present invention with vertical bumper-handles and a shelf attached to the cabinet.

FIG. 4 shows a configuration 400 useful in embodiments of the present invention. In this configuration 400, a rectangular top 404 and a rectangular bottom 402 (or base) are attached to the back outer-wall 104, the left-side outer-wall 102, and the right-side outer-wall 106. A top, bottom, back outer-wall, left-side outer-wall, and right-side outer-wall are collectively referred to herein as a cabinet. Four vertical bumper-handles 408 (three shown) are attached to the top 404 and the bottom 402 near each corner of the top 404 and bottom 402. A shelf 406 is attached to both the left-side inner-wall 200 and the right-side inner-wall (not shown).

In preferred embodiments, the bottom 402 will have four caster assemblies (not shown) attached to it, one caster assembly at each corner of the bottom 402. Caster assemblies are known in the art and the type of caster assembly and the means for attaching the assemblies to the bottom 402 are not particularly critical to the present invention. In fact, a stationary service cart can be produced in accordance with the present invention without caster assemblies.

The vertical bumper-handles 408 serve as bumpers, providing a cushioning effect that enables a user to move the service cart from place to place in a manner that both protects sensitive electronic equipment carried by the service cart and protects other neighboring equipment, vehicles, walls, etc. from damage when inevitable minor collisions occur. The bumper-handles 408 also serve as handles, allowing a user to easily grab on to the cart and pull or push the cart into a desired position.

Preferred embodiments of the present invention include a plurality of slots on the top, the slots being adapted to hold mounting brackets adjustable along the length of the slots. In preferred embodiments, the top also includes a lip on at least one side of the top. For example, the top 404 includes a lip 412 on three sides of the top 404. The lip 412 significantly reduces the chance that loose items will slide or roll off of the top 404.

Figure 5:
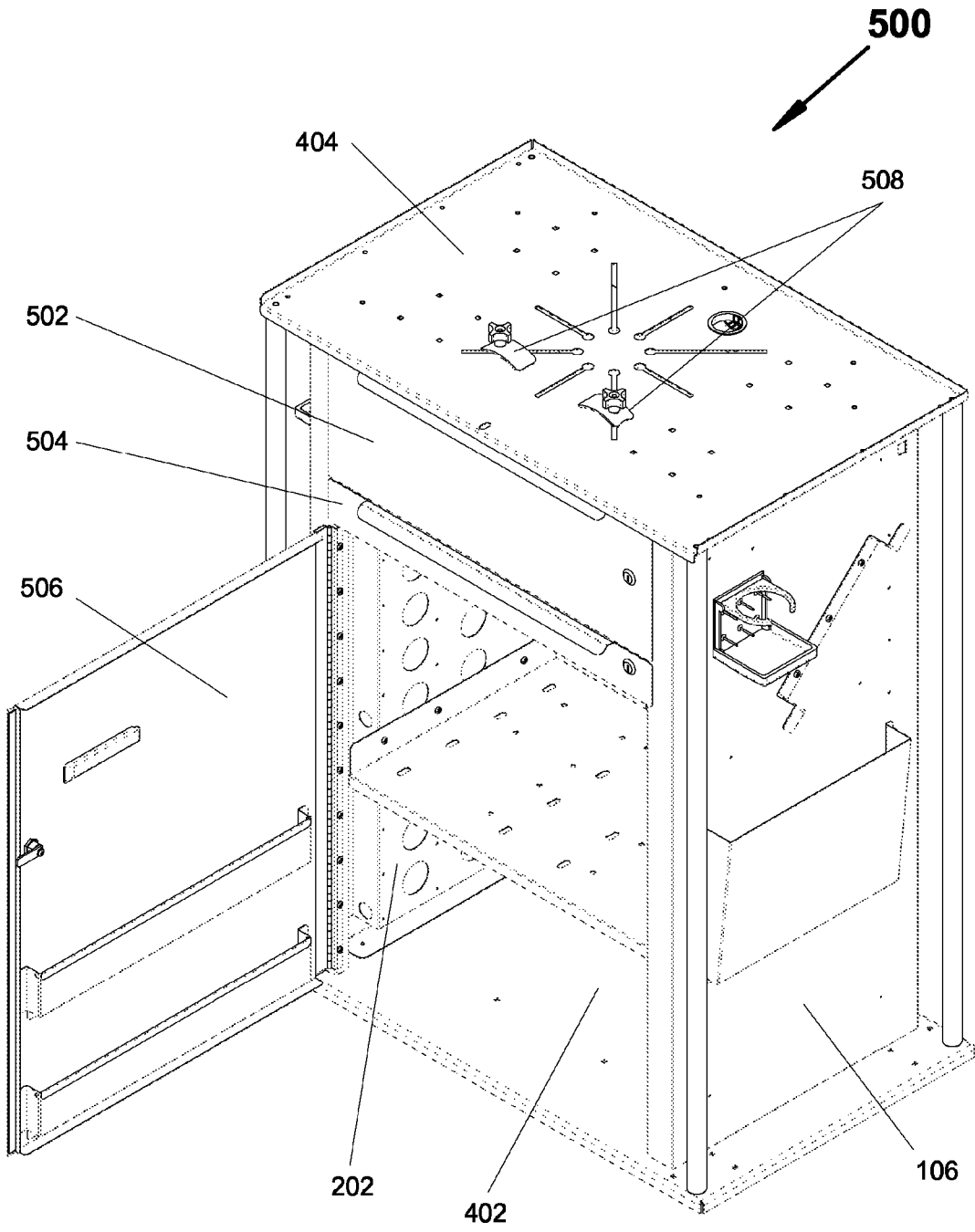
FIG. 5 shows an embodiment of the present invention illustrating configurable storage spaces.

The top 404 includes eight slots 410 for use with mounting brackets 508 (FIG. 5). Other embodiments may use a greater or a lesser number of slots. The mounting brackets 508 can be adjusted by loosening the brackets 508 and sliding the loosened brackets 508 along the length of the slot to a desired position. Once a bracket 508 is in the desired position it can be tightened again. In this manner, a plurality of mounting brackets 508 can be used to hold in place a computer monitor, for example, with virtually any size or shape base. The plurality of brackets 508 can be adjusted so they are positioned around the monitor base and tightened to hold the monitor base in place. The mounting brackets 508 may also be advantageously utilized to hold other items, such as a laptop computer or electronic tools, for example.

The configuration 400 in FIG. 4 shows a shelf 406 attached to both the left inner-wall 200 and the right inner-wall (not shown) using the fifth row of holes 208 from the bottom 402. Thus, the height of the storage space below the shelf will be about five times the minimum, storage space height. Since the side inner-walls are not flush against the bottom 402, the very lowest storage space will have an additional space equal to about the minimum, storage space height.

FIG. 5 shows the configuration 400 with a door 506 attached in a manner such that, when the door 506 is closed, it covers the storage space below the shelf 406 and covers the storage space above the shelf 406. Alternately, doors that are hinged at the bottom to form drop down doors, instead of hinged at the side like the door 506 in FIG. 5, can be advantageously utilized in embodiments of the present invention. FIG. 5 also illustrates a drawer 504 having a height approximately equal to the minimum, storage space height and a larger drawer 502 having a height approximately equal to three times the minimum height. Either or both drawers may have in-the-drawer power as described above. Thus, the configuration 500 provides a storage space below the shelf 406 equal to about five times the minimum height, a storage space above the shelf 406 equal to about five times the minimum height, a first drawer 504 equal to about the minimum height, and a second drawer 502 equal to about three times the minimum height.

Service carts of the present invention are re-configurable so they can be customized to a particular user's needs. For example, the shelf 406 can be raised or lowered, changing the height of the storage space above or below it. If the shelf 406 were raised to the next highest set of holes 208, then the storage space below the shelf 406 would be increased to a height equal to about six times the minimum height and the storage space above the shelf 406 (and below the first drawer 504) would be reduced to a height equal about four times the minimum height. The positions of the first drawer 504 and the second drawer 502 could be exchanged, putting the first drawer 504 on top (that is, closer to the top of the cabinet) and the second drawer 502 just below the first drawer 504. Alternately, the second drawer 502 could be replaced with two smaller drawers. For example, the second drawer 502 could be replaced with a drawer the same height as the first drawer 405 and another drawer having a height about three times the minimum height.

Figure 6:
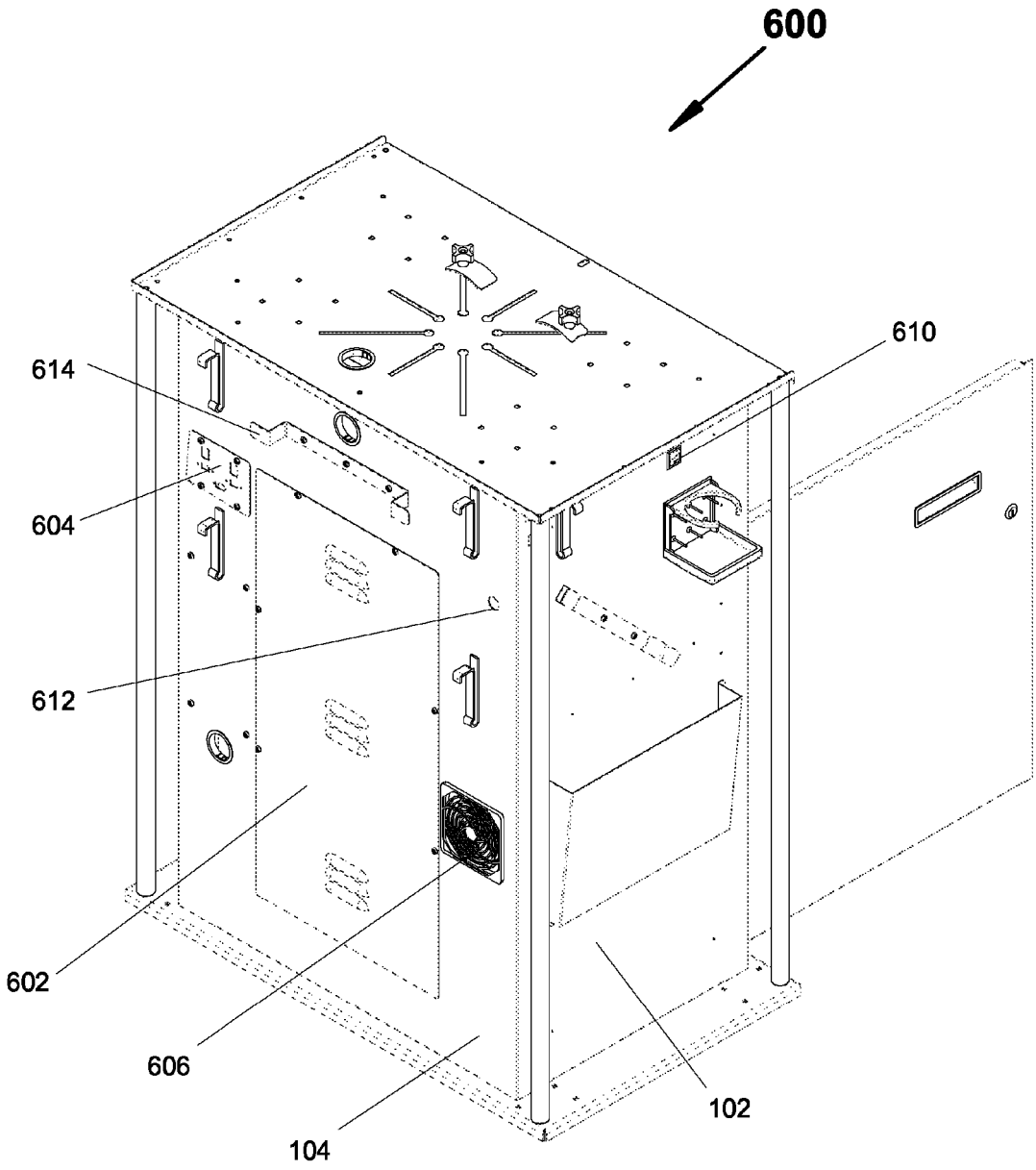
FIG. 6 is a view of the embodiment shown in FIG. 5 rotated 180 degrees so as to illustrate the back of the embodiment.

FIG. 6 shows a view of the configuration 500 rotated 180 degrees so that the back outer-wall 104 and the left outer-wall 102 are visible. The back outer-wall 104 includes a rear-access panel 602 that allows a user to easily reach into the inside of the cabinet from the back when the panel 602 is removed. For example, users can reach into the cabinet to add, remove, or reposition electrical cords by pulling the cords through the holes 206 in the side inner-walls. The electrical cords can be easily plugged into or removed from the portion of the communications plate 604 facing the inside of the cabinet. Other equipment may also be inserted into, repositioned, or removed from the cabinet through the rear-access panel 602 as well. The rear-access panel 602 also includes cooling vents that enable the electronic equipment contained within the cabinet to be ventilated. The cooling vents are not required to be on the rear-access panel 602, but may be positioned in one or more places on any of the outer-walls.

The rear outer-wall 104 also includes a communications plate 604, a fan 606 for venting the cabinet, a power switch 610, a power cord portal 612, and a power cord rack 614. The power cord portal 612 allows a power cord (not shown) that is electrically attached to an electrical outlet box (not shown) inside the cabinet to pass through the back outer-wall 104 so that in can be plugged into any electrical outlet available externally to the cabinet, such as a standard electrically outlet in a wall. When not in use, the power cord can be stored by winding it around the power cord rack 614. The power switch 610 allows the power inside the cabinet to be turned off while the power cord remains plugged into an outlet. Thus, the power switch 610 serves as a master on/off switch that allows all electrical equipment inside the cabinet to be turned off while the power cord is still plugged into an external outlet.

In a preferred embodiment, the fan 606 pulls air into the cabinet, through a filter, at a rate of about 70 cfm. This results in an air flow through the cabinet of the service cart that helps cool any electronic equipment inside the cart. Preferably, the air is pulled into the cabinet at a rate sufficient to provide a positive pressure in the cabinet that reduces the amount of air that can enter the cabinet other that through the fan. The cabinet shown in FIGS. 4-6 will contain about 30 cf when completely empty (i.e., no equipment or tools). Thus, in a preferred embodiment the fan 606 pulls in a volume of air greater than or equal to about twice the volume of an empty cabinet (the "empty volume") every minute. Also, because the fan 606 pulls the air into the cabinet through a filter, the pulled-in air is cleaner than the air external to the service cart. In this way, the fan 606 helps keep equipment in the service cart clean in addition to keeping the equipment cool.

In accordance with the present invention, novel service carts are provided. The novel service carts are sufficiently flexible to be advantageously utilized as both diagnostic carts and tool carts in a variety of working environments. While the present invention has been shown and described herein with reference to specific embodiments thereof, it should be understood by those skilled in the art that variations, alterations, changes in form and detail, and equivalents may be made or conceived of without departing from the spirit and scope of the invention. Accordingly, the scope of the present invention should be assessed as that of the appended claims and by equivalents thereto.

What is claimed is:

1. A service cart, comprising: a cabinet having two side outer-walls, a back outer-wall, a bottom, and a top; a plurality of configurable storage spaces in the cabinet, each storage space having a height that is approximately an integer multiple of a minimum storage space height; an electrical outlet box inside a cabinet, the outlet box being electrically connected to an electrical power cord external to the cabinet; and at least one drawer having an electrical outlet positioned inside the drawer and electrically connected to the electrical outlet box.

2. A service cart according to claim 1, wherein the cabinet top comprises a plurality of slots adapted to hold mounting brackets adjustable along a length of the slots.

3. A service cart according to claim 1, wherein the cabinet includes a fan that pulls air into the cabinet through a filter.

4. A service cart capable of holding both automobile diagnostic tools and automobile repair tools, comprising:

a cabinet defining two side outer-walls, a back outer-wall, a bottom, and a top of the service cart; and an electrical outlet box inside the cabinet, the outlet box being electrically connected to an electrical power cord external to the cabinet; and at least one drawer having an electrical outlet positioned inside the drawer and electrically connected to the electrical outlet box.

5. A service cart according to claim 4, wherein the cabinet top comprises a plurality of slots adapted to hold mounting brackets adjustable along a length of the slots.

6. A service cart according to claim 4, wherein the cabinet includes a fan that pulls air into the cabinet, through a filter.

7. A service cart according to claim 5, wherein the cabinet includes a fan that pulls air into the cabinet through a filter.

8. A service cart, comprising a cabinet having two side outer-walls, a back outer-wall, a bottom, and a top comprising a plurality of slots adapted to hold mounting brackets adjustable along a length of the slots.

9. A service cart according to claim 8, wherein the cabinet includes a fan that pulls air into the cabinet, through a filter.

10. A service cart according to claim 9, wherein the cabinet includes a plurality of configurable storage spaces, each storage space having a height that is approximately an integer multiple of a minimum storage space height.

11. A service cart capable of holding both automobile diagnostic tools and automobile repair tools, comprising:

a cabinet defining two side outer-walls, a back outer-wall, a bottom, and a top of the service cart; the top comprising a plurality of slots adapted to hold mounting brackets adjustable along a length of the slots;

a plurality of configurable storage spaces in the cabinet, each storage space having a height that is approximately an integer multiple of a minimum storage space height;

an electrical outlet box inside the cabinet, the outlet box electrically connected to an electrical power cord external to the cabinet;

at least one drawer having an electrical outlet positioned inside the drawer and electrically connected to the electrical outlet box; and a fan that pulls air into the cabinet through a filter.

12. A service cart according to claim 11, wherein the minimum storage space height is about 3 inches.

13. A service cart according to claim 11, further comprising a plurality of vertical bumper-handles.

14. A service cart according to claim 11, further comprising four vertical bumper-handles, each bumper-handle being attached to the cabinet top and bottom near a corner of the top and bottom.

15. A service cart according to claim 11, wherein the cabinet has an empty volume and the fan pulls in a volume of air greater than or equal to about twice the empty volume every minute.

16. A service cart according to claim 15, wherein the empty volume is about 30 ct and the fan pulls in air at a rate of about 70 cfm.

* * * * *